US012213606B2

(12) United States Patent
Zhou

(10) Patent No.: US 12,213,606 B2
(45) Date of Patent: Feb. 4, 2025

(54) STRAW CUP

(71) Applicant: Ningbo Hailan Plastic Industry Co., Ltd., Ningbo (CN)

(72) Inventor: Shuibing Zhou, Ningbo (CN)

(73) Assignee: Ningbo Hailan Plastic Industry Co., Ltd., Ningbo (CN)

( * ) Notice: Subject to any disclaimer, the term of this patent is extended or adjusted under 35 U.S.C. 154(b) by 45 days.

(21) Appl. No.: 18/102,153

(22) Filed: Jan. 27, 2023

(65) Prior Publication Data

US 2023/0320506 A1 Oct. 12, 2023

(30) Foreign Application Priority Data

Apr. 11, 2022 (CN) ..... 202220826428.1

(51) Int. Cl.
*A47G 19/22* (2006.01)

(52) U.S. Cl.
CPC ..... *A47G 19/2272* (2013.01)

(58) Field of Classification Search
CPC ..... A47G 19/2272
See application file for complete search history.

(56) References Cited

U.S. PATENT DOCUMENTS

| | | | | |
|---|---|---|---|---|
| 9,307,851 | B1 * | 4/2016 | Rhodes | A47G 21/182 |
| D781,653 | S | 3/2017 | Matthis et al. | |
| D804,907 | S | 12/2017 | Sandoval | |
| D873,603 | S | 1/2020 | Diener et al. | |
| D891,866 | S | 8/2020 | Ames | |
| 2014/0069944 | A1 | 3/2014 | Shapiro | |
| 2015/0102029 | A1 | 4/2015 | Bargiel | |
| 2016/0235229 | A1 * | 8/2016 | Löhn | B65D 47/06 |
| 2016/0286992 | A1 | 10/2016 | Sladics | |
| 2019/0375559 | A1 | 12/2019 | Spivey | |

OTHER PUBLICATIONS

Office Action mailed Jan. 3, 2023 in U.S. Appl. No. 17/320,420.

* cited by examiner

*Primary Examiner* — Stephen J Castellano
(74) *Attorney, Agent, or Firm* — Ostrager Chong Flaherty & Broitman P.C.

(57) ABSTRACT

The utility model provides a straw cup, comprising a cup body and a cup cover connected to the cup body, wherein the cup cover is provided with a mounting hole, and a sealing element made of an elastic material is connected in the mounting hole; and a suction nozzle extending upward vertically and communicated with the inner cavity of the cup body is arranged at the top of the sealing element, and the sealing element and the suction nozzle are integrated in one piece. An insertion hole communicated with the suction nozzle is arranged at the bottom of the sealing element, a straw is arranged in the cup body, and one end of the straw is detachably connected in the insertion hole and is in interference fit with the insertion hole. The suction nozzle and the sealing element are connected together and integrated in one piece, which can reduce manufacturing procedures, save the production cost, prevent the straw from being pulled from the cup body by children and prevent the straw from being is polluted, so as to prevent water in the cup body from being polluted and avoid loss of the straw. In addition, the suction nozzle, as the extension of the straw outside the cup body, can shorten the length of the straw; and the straw and the insertion hole are detachably connected, which is convenient for users to split and clean, and the cleaning process is simple and convenient.

6 Claims, 4 Drawing Sheets

STRAW CUP

TECHNICAL FIELD

The utility model relates to the technical field of cups, and particularly relates to a straw cup.

BACKGROUND

A water cup is a container used to hold water, and is an essential item in our daily life. A common water cup comprises a cup cover and a cup body. The cup cover is opened when people need to drink water, and tightened when people do not need to drink water. Although such water cup is convenient to use, the diameter of the cup body is usually large, which is not suitable for children. To prevent children from spilling water everywhere when drinking, a children water cup is usually provided with an insertion hole in the cup cover and a straw is arranged in the insertion hole to facilitate children to suck water through the straw.

However, children are curious and often remove the straw from the water cup, which is easy to dirty the straw and then pollute water in the water cup. In addition, the removed straw is easy to lose, causing the water cup to be unusable. Moreover, due to the influence of the depth of the cup body, the straw is usually made longer, which makes the cleaning of the straw more troublesome and requires a particularly slender cleaning tool to clean.

SUMMARY

A technical problem to be solved in the utility model is to overcome the defects of the prior art and to provide a straw cup which is convenient for children to use and has a straw not easy to lose and easy to clean.

The utility model adopts the technical solution that a straw cup with the following structure is provided: the straw cup comprises a cup body and a cup cover connected to the cup body; the cup cover is provided with a mounting hole penetrating the cup cover, and a sealing element made of an elastic material is detachably connected in the mounting hole; and a suction nozzle communicated with the inner cavity of the cup body is arranged at the top of the sealing element, the bottom of the sealing element is detachably connected with a straw, and the straw is communicated with the suction nozzle.

With the above structure, the straw cup of the utility model has the following advantages compared with the prior art:

The suction nozzle and the sealing element are connected together, which can prevent the straw from being pulled from the cup body by children and prevent the straw from being polluted, so as to prevent water in the cup body from being polluted and avoid loss of the straw. In addition, the suction nozzle, as the extension of the straw outside the cup body, can shorten the length of the straw, and is convenient to clean.

Preferably, the peripheral wall of the sealing element is provided with a through slot extending along the height direction of the sealing element, and the through slot is enclosed with the inner wall of the mounting hole to form an air return passage.

Preferably, an annular flange extending radially is arranged at the bottom of the peripheral wall of the sealing element, and the annular flange is abutted against with the outer edge of the lower opening of the mounting hole; and in the initial state, the air return passage is closed by the annular flange. In this way, water in the cup body can be prevented from flowing out through the air return passage, and the leakproofness of the cup body is enhanced; and when a user sucks water, the air pressure in the cup body decreases, and outside air enters through the air return passage and pushes down the annular flange open to enter the cup body so as to prevent negative pressure in the cup body.

Preferably, an annular groove is arranged in the middle of the peripheral wall of the sealing element, the mounting hole is provided with a bulge loop matched with the annular groove, and the bulge loop is clamped in the annular groove. In this way, the sealing element and the mounting hole are connected more firmly, which prevents the sealing element from being removed by children easily.

Preferably, an insertion hole communicated with the suction nozzle is arranged at the bottom of the sealing element, one end of the straw is in interference fit in the insertion hole, and the end of the straw is abutted against with the lower end of the suction nozzle. One end of the straw is detachably connected in the insertion hole, which is convenient for users to clean.

Preferably, the sealing element and the suction nozzle are integrated in one piece. In this way, manufacturing procedures can be reduced, and production cost can be saved.

Preferably, the suction nozzle is sheathed with a decorating part. The decorating part can play a decorative role and be convenient for children to pinch to adjust the angle of the suction nozzle.

REFERENCE SIGNS

1 cup body, 2 cup cover, 3 mounting hole, 4 sealing element, 5 suction nozzle, 6 straw, 7 through slot, 8 air return passage, 9 annular flange, 10 annular groove, 11 bulge loop, 12 insertion hole, and 13 decorating part.

DETAILED DESCRIPTION

The utility model is further described below in detail in combination with the drawings and specific embodiments.

It should be understood in the description of the utility model that terms such as "upper", "lower", "front", "rear", "left", "right", "vertical", "horizontal", "top", "bottom", "inner" and "outer" indicate direction or position relationships shown based on the drawings, and are only intended to facilitate the description of the utility model and the simplification of the description rather than to indicate or imply that the indicated device or element must have a specific direction or constructed and operated in a specific direction, and therefore, shall not be understood as a limitation to the utility model. At the same time, the terms such as "first" and "second" are only used to distinguish the names of the components and have no primary and secondary relationship, and thus shall not be understood as a limitation to the utility model.

Figure 1:
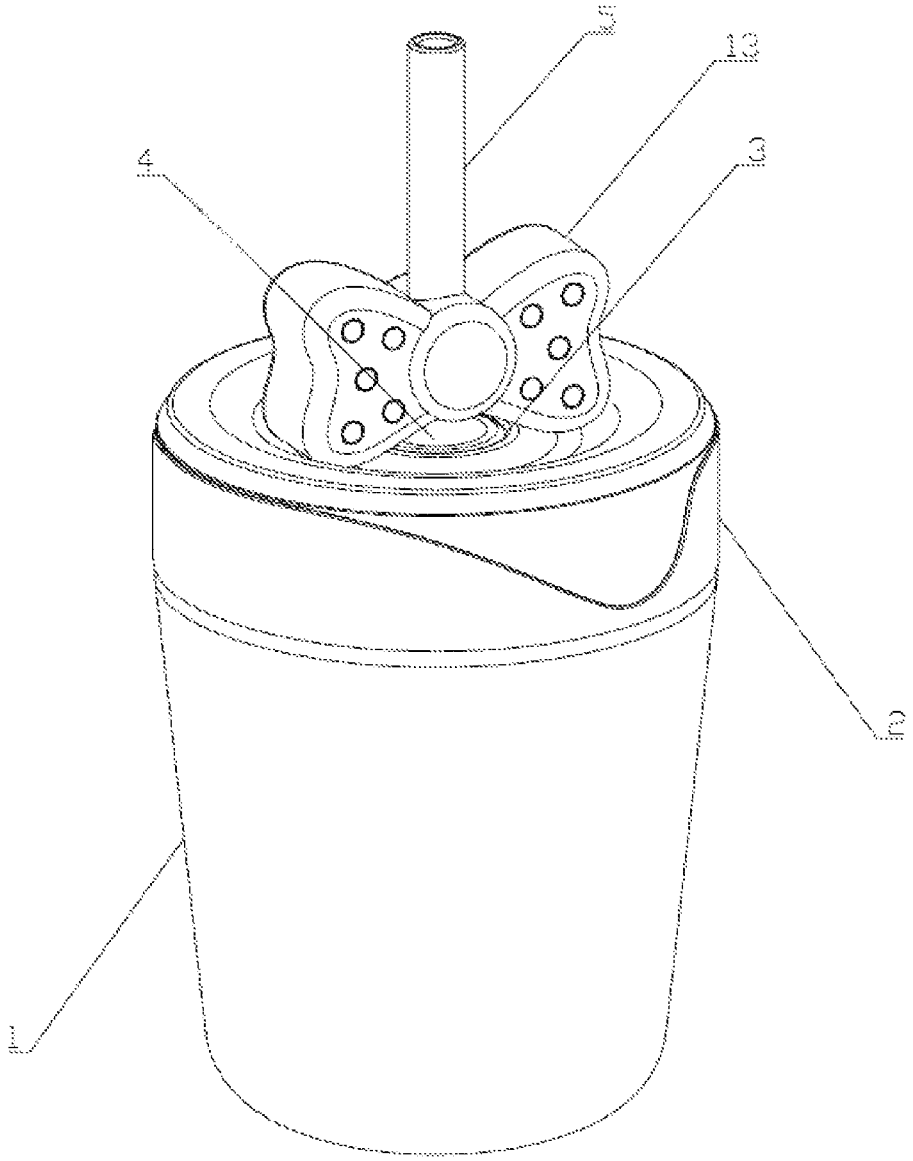
FIG. 1 is a structural schematic diagram of the utility model.
Figure 2:
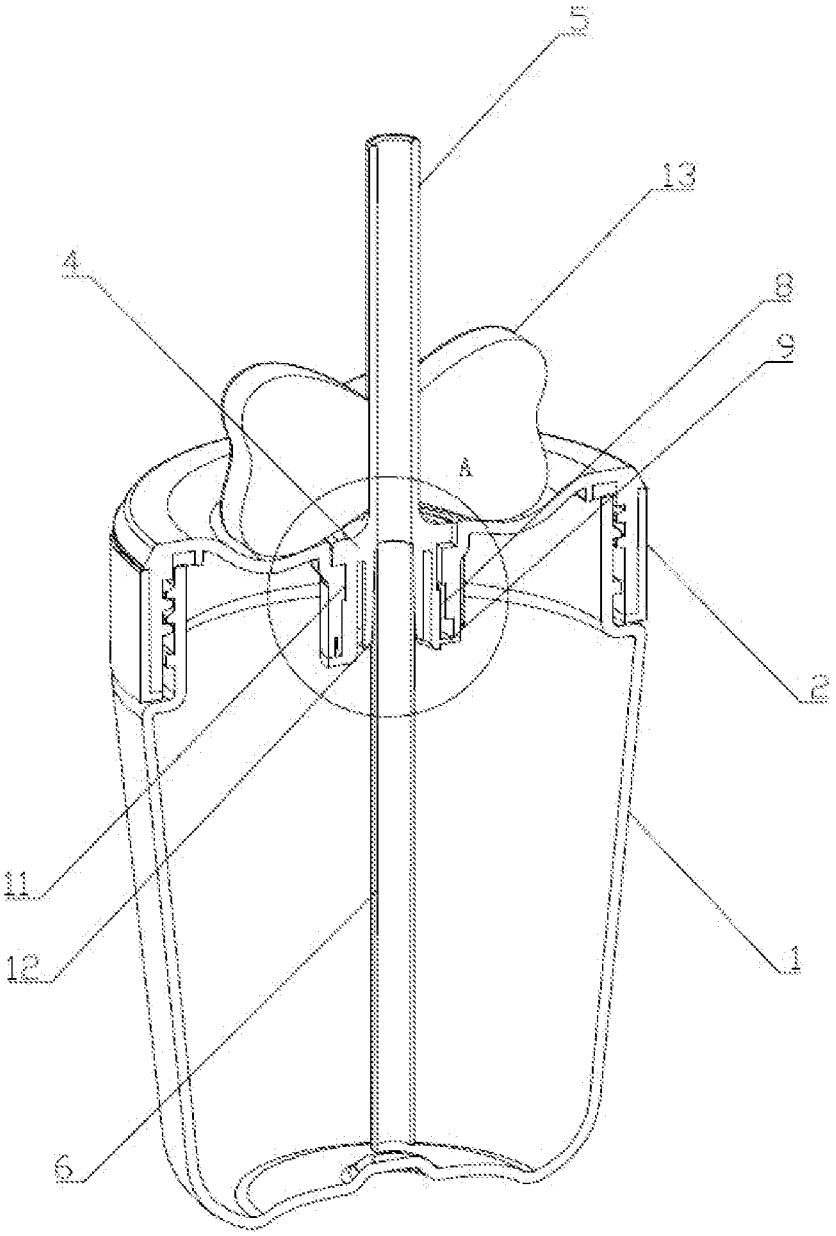
FIG. 2 is a semisectional view of the utility model.
Figure 3:
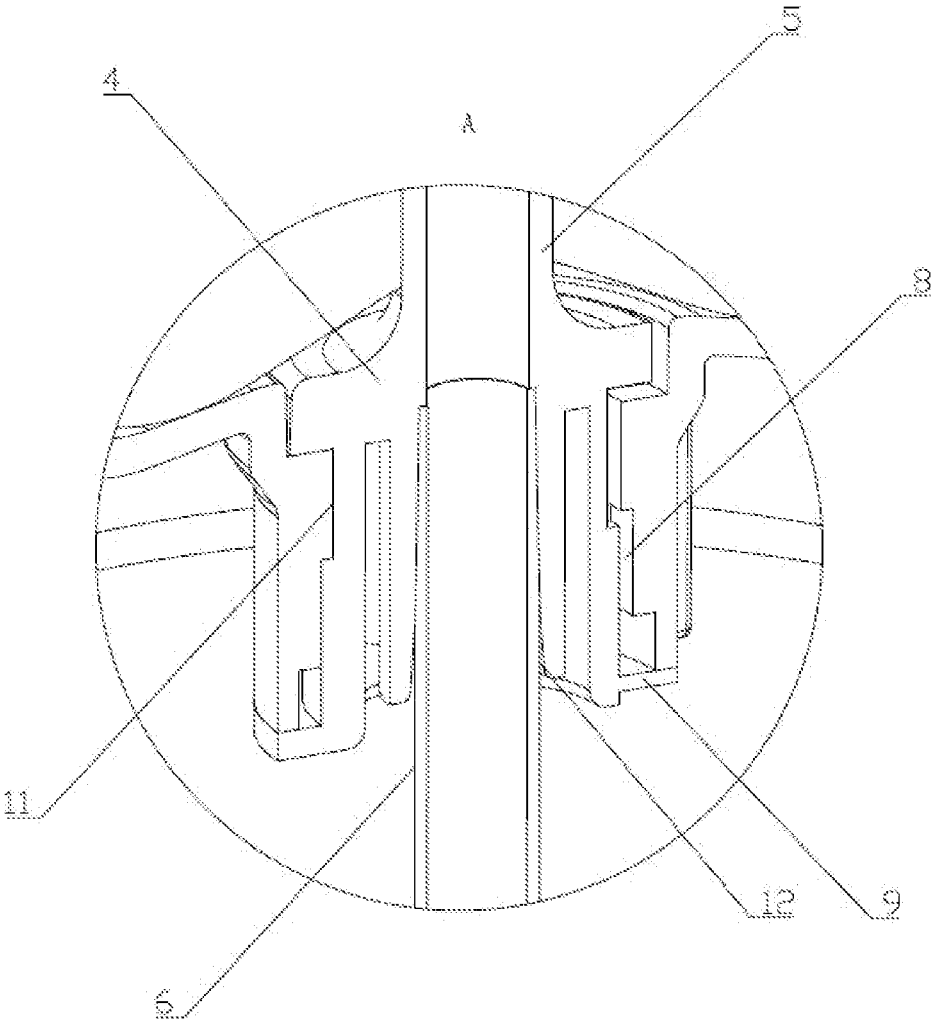
FIG. 3 is an enlarged view of Position A of FIG. 2.
Figure 4:
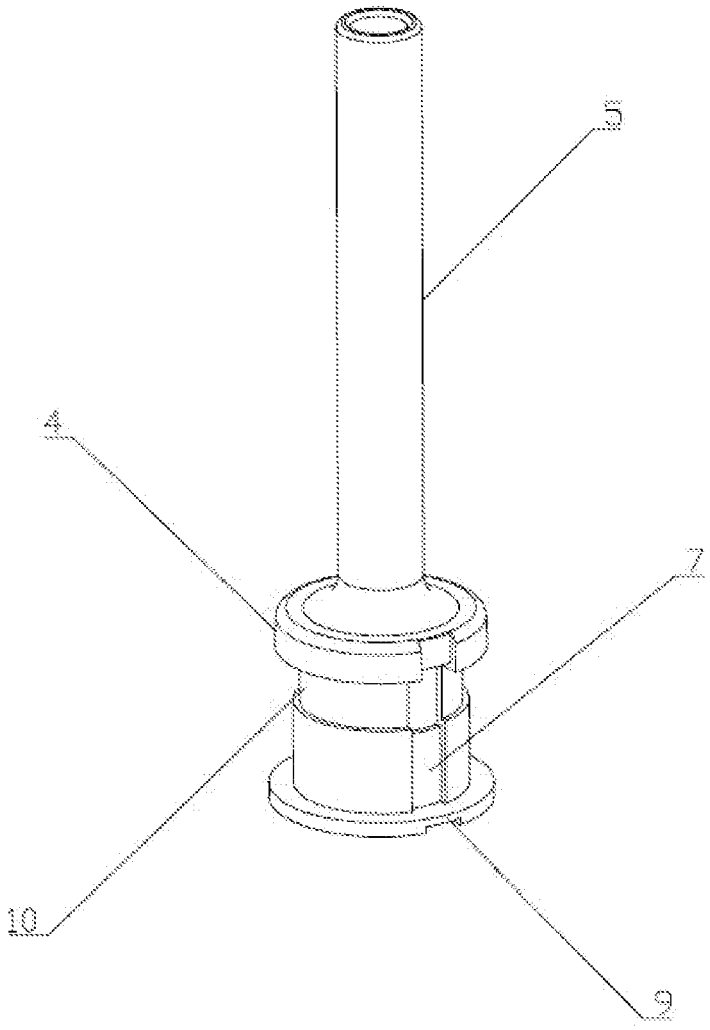
FIG. 4 is a structural schematic diagram of a sealing element and a suction nozzle in the utility model.

As shown in FIG. 1, FIG. 2, FIG. 3 and FIG. 4:

The utility model discloses a straw cup, comprising a cup body 1 and a cup cover 2 in threaded connection to the cup body 1. The cup cover 2 is provided with a mounting hole 3 penetrating the upper and lower end faces of the cup cover 2, and a sealing element 4 made of an elastic material (such as silica gel or plastics) is detachably connected in the mounting hole 3; and a suction nozzle 5 extending upward vertically and communicated with the inner cavity of the cup body 1 is arranged at the top of the sealing element 4, and the sealing element 4 and the suction nozzle 5 are integrated in one piece. An insertion hole 12 communicated with the suction nozzle 5 is arranged at the bottom of the sealing element 4, a straw 6 is arranged in the cup body 1, and one end of the straw 6 is detachably connected in the insertion hole 12 and is in interference fit with the insertion hole 12. The dimension of the inner diameter of the insertion hole 12 is larger than that of the suction nozzle 5, and the dimension of the inner diameter of the straw 6 is the same as that of the suction nozzle 5; and when one end of the straw 6 is inserted into the insertion hole 12, the end of the straw is abutted against the lower end of the suction nozzle.

The suction nozzle 5 and the sealing element 4 are connected together and integrated in one piece, which can reduce manufacturing procedures, save the production cost, prevent the straw 6 from being pulled from the cup body 1 by children and prevent the straw 6 from being polluted, so as to prevent water in the cup body 1 from being polluted and avoid loss of the straw 6. In addition, the suction nozzle 5, as the extension of the straw 6 outside the cup body 1, can shorten the length of the straw 6; and the straw 6 and the insertion hole 12 are detachably connected, which is convenient for users to split and clean, and the cleaning process is simple and convenient.

The peripheral wall of the sealing element 4 is provided with a through slot 7 extending along the height direction of the sealing element 4, and the through slot 7 is enclosed with the inner wall of the mounting hole 3 to form an air return passage 8. An annular flange 9 extending radially is arranged at the bottom of the peripheral wall of the sealing element 4, and the annular flange 9 is abutted against with the outer edge of the lower opening of the mounting hole 3. In the initial state, the air return passage 8 is closed by the annular flange 9, which can prevent water in the cup body 1 from flowing out through the air return passage 8 and enhance the leakproofness of the cup body 1. When a user sucks water, the air pressure in the cup body 1 decreases, and outside air enters through the air return passage 8 and pushes down the annular flange 9 open to enter the cup body 1 so as to prevent negative pressure in the cup body 1. The material of the annular flange 9 is the same as that of the sealing element 4 and has certain elasticity and small thickness, and the annular flange 9 is similar to an annular check valve diaphragm and can be easily pushed open by outside air when negative pressure is produced in the cup body 1. In addition, the annular flange 9 can be provided with a notch in the position near the through slot 7, and the notch is closed in the initial state; the notch can be more convenient for air to push open and enter when negative pressure is produced in the cup body 1; and the notch returns to the initial state and automatically closes when the internal pressure and the external pressure of the cup body 1 are consistent.

An annular groove 10 is arranged in the middle of the peripheral wall of the sealing element 4, the mounting hole 3 is provided with a bulge loop 11 matched with the annular groove 10, and the bulge loop 11 is clamped in the annular groove 10. In this way, the sealing element 4 and the mounting hole 3 are connected more firmly, which prevents the sealing element 4 from being removed by children easily. The suction nozzle 5 is sheathed with a decorating part 13 which can play a decorative role and be convenient for children to pinch to adjust the angle of the suction nozzle 5.

The above only describes the specific embodiments of the utility model, but the protection scope of the utility model is not limited thereto. Any change or replacement contemplated easily by those skilled in the art familiar with the is technical field within the technical scope disclosed by the utility model shall be covered within the protection scope of the utility model. Therefore, the protection scope of the utility model shall be determined by the protection scope of the claims.

The invention claimed is:

1. A straw cup, comprising a cup body (1) and a cup cover (2) connected to the cup body (1), wherein the cup cover (2) is provided with a mounting hole (3) penetrating the cup cover (2), and a sealing element (4) made of an elastic material is detachably connected in the mounting hole (3); and a suction nozzle (5) communicated with the inner cavity of the cup body (1) is arranged at the top of the sealing element (4), the bottom of the sealing element (4) is detachably connected with a straw (6), and the straw (6) is communicated with the suction nozzle (5) and a peripheral wall of the sealing element (4) is provided with a through slot (7) extending along a height direction of the sealing element (4), and the through slot (7) is enclosed with an inner wall of the mounting hole (3) to form an air return passage (8).

2. The straw cup according to claim 1, wherein an annular flange (9) extending radially is arranged at the bottom of the peripheral wall of the sealing element (4), and the annular flange (9) is abutted against with the outer edge of the lower opening of the mounting hole (3); and in the initial state, the air return passage (8) is closed by the annular flange (9).

3. The straw cup according to claim 1 or 2, wherein an annular groove (10) is arranged in the middle of the peripheral wall of the sealing element (4), the mounting hole (3) is provided with a bulge loop (11) matched with the annular groove (10), and the bulge loop (11) is clamped in the annular groove (10).

4. The straw cup according to claim 1, wherein an insertion hole (12) communicated with the suction nozzle (5) is arranged at the bottom of the sealing element (4), one end of the straw (6) is in interference fit in the insertion hole (12), and the end of the straw (6) is abutted against with the lower end of the suction nozzle (5).

5. The straw cup according to claim 1, wherein the sealing element (4) and the suction nozzle (5) are integrated in one piece.

6. The straw cup according to claim 1, wherein the suction nozzle (5) is sheathed with a decorating part (13).

* * * * *